US005234267A

United States Patent [19]

Pauer et al.

[11] Patent Number: 5,234,267

[45] Date of Patent: Aug. 10, 1993

[54] HUTCH UTILIZING A TENSION ROD FRAME

[75] Inventors: Jericho P. Pauer, Onalaska; Jane Pronschinske, Winona, both of Wis.

[73] Assignee: Ashley Furniture Industries, Inc., Arcadia, Wis.

[21] Appl. No.: 748,501

[22] Filed: Aug. 22, 1991

[51] Int. Cl.[5] ..... A47B 47/00

[52] U.S. Cl. ..... 312/140; 312/312; 248/244

[58] Field of Search ..... 312/140, 264, 244, 265, 312/306, 312, 257.1, 265.4; 248/244, 243; 108/111; 400/362

[56] References Cited

U.S. PATENT DOCUMENTS

| | | | |
|---|---|---|---|
| D. 181,285 | 10/1957 | Gaines . | |
| D. 198,325 | 6/1964 | Smith . | |
| D. 263,359 | 3/1982 | Parrish . | |
| D. 279,064 | 6/1985 | Scholl . | |
| D. 295,702 | 5/1988 | Huffstetler . | |
| D. 301,419 | 6/1989 | Rosen . | |
| 615,915 | 12/1898 | Scott et al. . | |
| 810,544 | 1/1906 | Krag . | |
| 1,716,032 | 6/1929 | Daugherty . | |
| 2,178,815 | 11/1939 | Shuart | 312/306 |
| 2,193,372 | 3/1940 | Miller . | |
| 2,240,767 | 5/1941 | Friedel | 312/215 X |
| 2,872,266 | 2/1959 | Holderle et al. . | |
| 3,286,662 | 11/1966 | Connery | 248/244 |
| 4,819,900 | 4/1989 | Funk | 248/244 |
| 4,998,841 | 3/1991 | Wilde | 403/362 X |

FOREIGN PATENT DOCUMENTS

| | | | |
|---|---|---|---|
| 1282146 | 12/1961 | France | 312/265 |

*Primary Examiner*—Peter R. Brown

*Attorney, Agent, or Firm*—Peterson, Wicks, Nemer & Kamrath

[57] ABSTRACT

A hutch (10) of a preferred form is shown including a top (14) and bottom (16) initially held in a spaced relation by their sandwiching between collars (35) and nuts (36, 37) fixed on and threaded on, respectively, the ends of vertical rods (32) extending through apertures (34) formed in the top (14) and bottom (16). The upper and lower edges of first and second glass ends (18) and first and second, glass, front sides (22) are slideably captured in groves (28, 30) formed in the top (14) and the bottom (16). Bolts (38) threaded in the top (14) abut with the upper edges of the ends (18) and sides (22) to compressively capture the ends (18) and sides (22) between the grooves (28, 30) and to tension the vertical rods (32). A back (20) including a mirrored face (26) is secured to the top (14) and bottom (16) to provide diagonal support of the frame. Glass shelves (40) are supported by independent shelf supports (42) adjustably and slideably positioned on the vertical tension rods (32). The tension rods (32) and shelf supports (42) include a highly reflective chrome plating to create the visual effect of the top (14) floating in a spaced, parallel relation above the bottom (16).

21 Claims, 2 Drawing Sheets

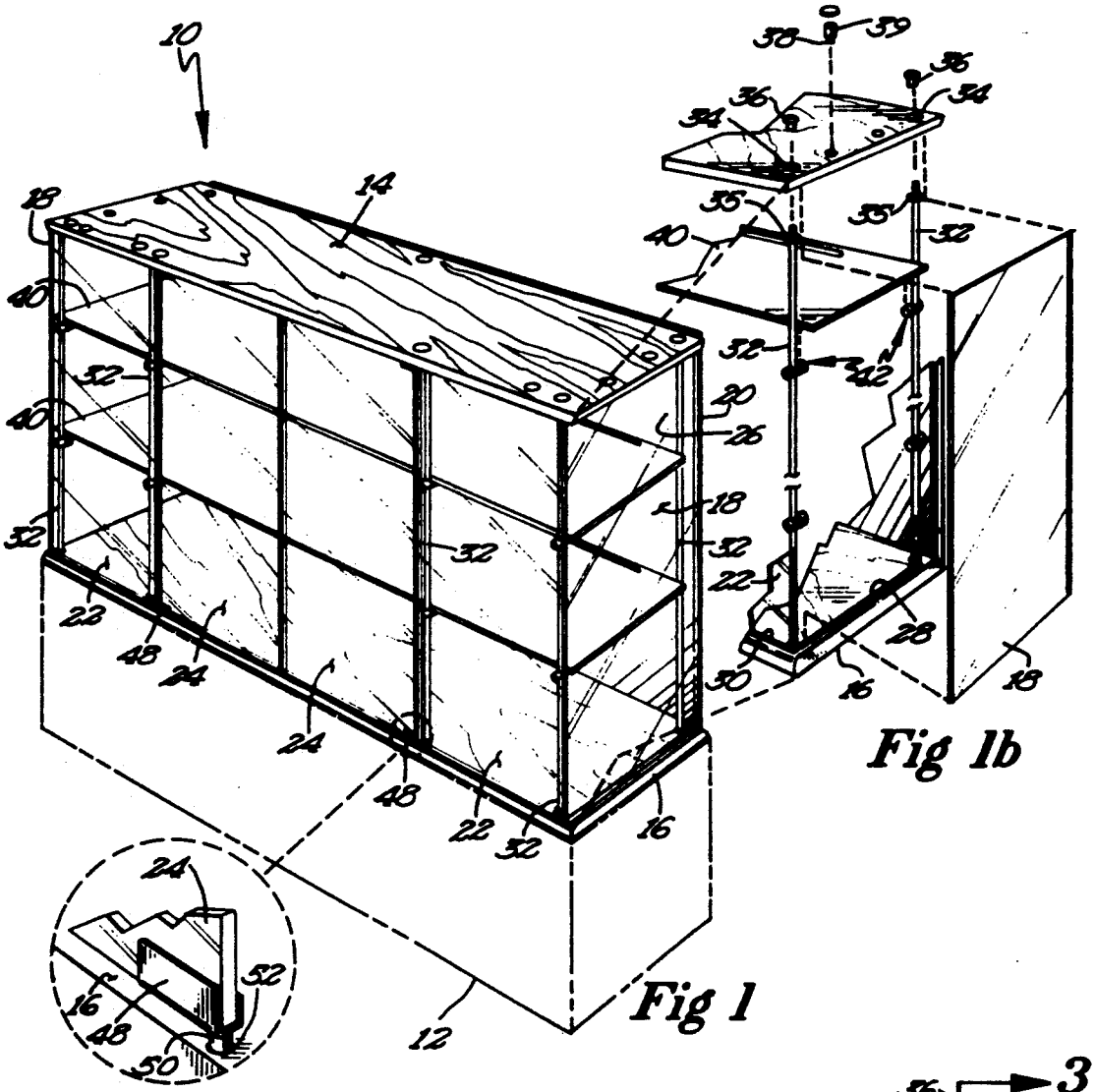
Fig 1b
Fig 1
Fig 1a
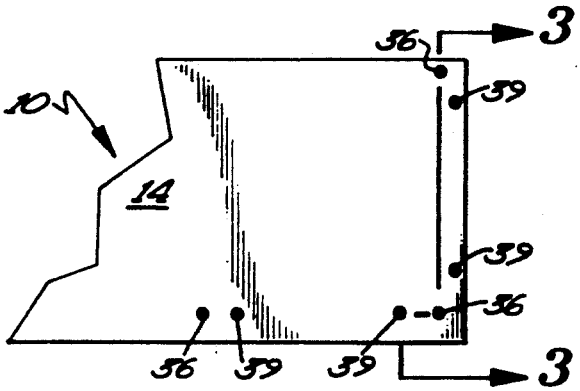
Fig 2

HUTCH UTILIZING A TENSION ROD FRAME

BACKGROUND

The present invention generally relates to hutches or cabinets, in a preferred form to hutches for storing and displaying china or the like, and particularly to hutches having frames formed of relatively low strength material such as glass.

During the storage and/or display of objects, it is often desirable to utilize as much glass as possible to maximize the viewing potential of the object. Although having strength against compressible forces, glass has relatively low strength when subjected to forces in other directions. Thus, prior to the present invention, separate structural members were utilized to form the frame of the hutch and/or to support the shelves inside of the hutch. Such structural members detract from the ability to visually observe objects displayed therein from relatively all angles without obstruction.

It should also be noted that prior cabinet designs, although utilizing tension rods, also utilized sectional partitions to support the shelves and the top which detracted from visual observation but also were generally inflexible in allowing variation in the number and positioning of shelves. Likewise, although some prior cabinet designs utilized rods as frame components, the support devices for objects in the cabinet extended between and relied upon at least two of such vertical rods, thus requiring such support devices to be of a relatively large size which also detracts from visual observation.

It is thus an object of the present invention to provide a unique hutch which minimizes the detraction from the visual observation of the interior of the hutch and the objects displayed therein. In a first aspect of the present invention, independent shelf supports of a relatively small size are independently adjustably positioned on at least three vertical rods arranged in a non-linear arrangement, with the shelf extending between and resting upon the shelf supports. It is thus an aim of the present invention to support shelves in a hutch with components of minimal size for reduced transport size in an unassembled condition and for reduced visual and physical space in the interior of the hutch.

In a further aspect of the present invention, the first and second ends of the hutch are compressively captured in members on the inner surfaces of the top and bottom. It is thus an aim of the present invention to allow the frame of the hutch to be formed of relatively low strength material such as glass, with the structural support having a minimal presence to detract from the visual and physical space of the hutch interior.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 shows a perspective view of a hutch according to the preferred teachings of the present invention, portions shown in phantom.

FIG. 2 shows a fragmentary top view of the hutch of FIG. 1.

Figure 3:
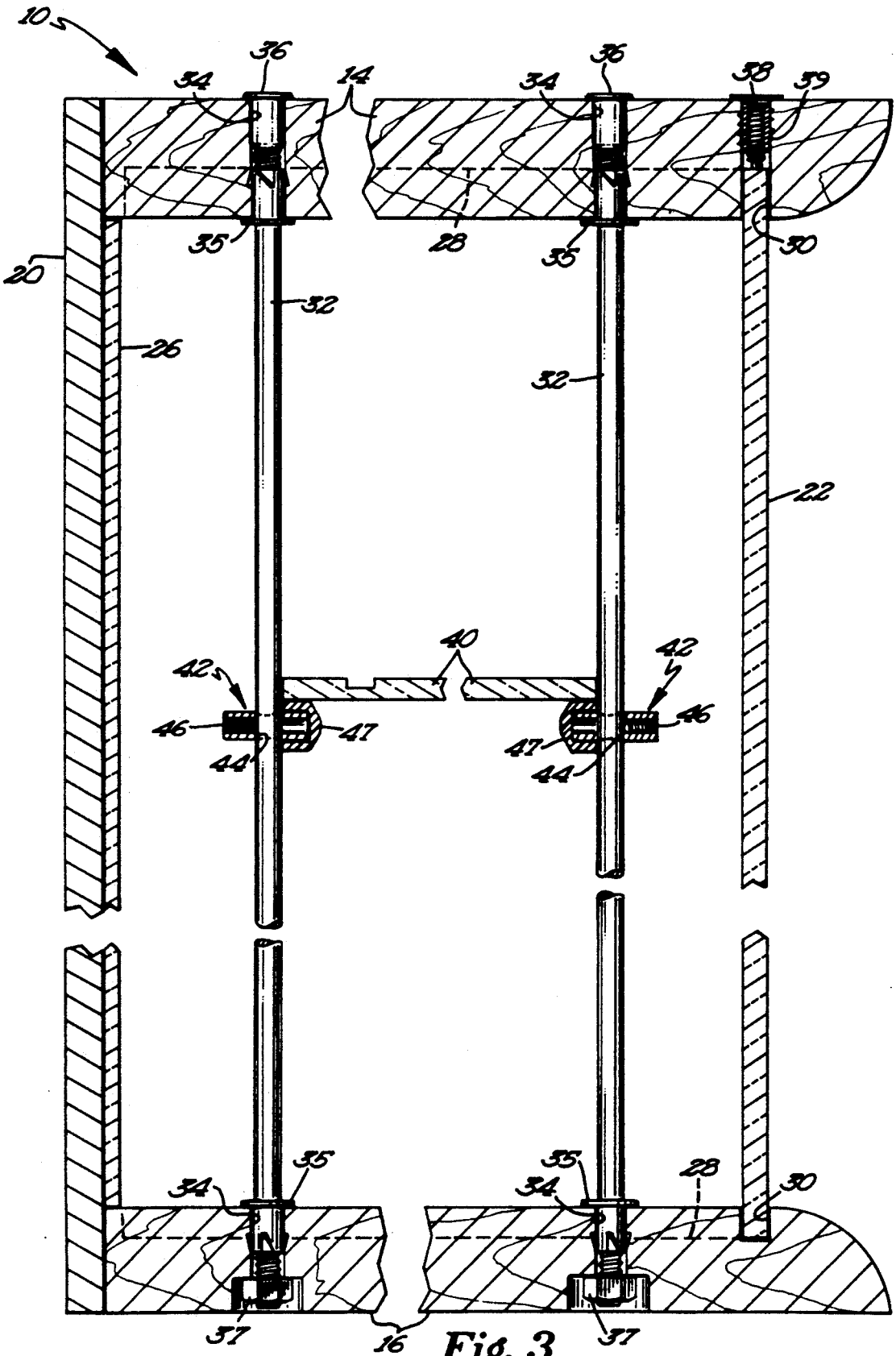
FIG. 3 shows a cross-sectional view of the hutch of FIG. 1 according to section line 3—3 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "inner", "rear", "side", "face", "end", "edge", "surface", and similar terms are used herein, it should be understood that these terms have reference only to the structure shown in the drawings as it would appear to a person viewing the drawings and are utilized only to facilitate describing the invention.

DESCRIPTION

A cabinet or hutch according to the preferred teachings of the present invention is shown in the drawings and generally designated 10. In the most preferred form, hutch 10 is located on top of a buffet and can be utilized to store and display china. Generally, hutch 10 includes a top 14, a bottom 16, first and second ends 18, a back 20, first and second front sides 22, and first and second door panels 24, with ends 18, front sides 22, and door panels 24 being formed of glass in the most preferred form. Further, in the most preferred form, back 20 is formed of a laminate including a mirrored front face 26. Back 20 has a size generally equal to the combined size of sides 22 and door panels 24.

The inner surfaces of top 14 and bottom 16 include first and second grooves 28 extending from the back edges thereof to a point spaced from the front edges thereof and of a size and shape for slideably receiving the upper and lower edges of ends 18, respectively. In the most preferred form, first and second grooves 28 of top 14 and of bottom 15 are parallel to each other and are located adjacent to but spaced inwardly of the end edges of top 14 and bottom 16. The inner surfaces of top 14 and bottom 16 further include first and second grooves 30 extending from and intersecting with the front ends of grooves 28 to a point spaced from each other. In the most preferred form, grooves 30 extend generally perpendicularly from grooves 28, with first and second grooves 30 lying along the same line and having their free ends spaced from each other.

Hutch 10 further includes a plurality of tension rods 32 extending through corresponding apertures 34 formed in top 14 and bottom 16 and extending between top 14 and bottom 16. First and second collars 35 are secured adjacent the opposite ends of rods 32 including a radially oriented circular flange spaced from the respective end a distance generally equal to but larger than the thickness of top 14 and bottom 16. In the most preferred form, collars 35 further include at least a first axially extending ear which is pressed against the side of apertures 34 to prevent rotation of rods 32 within apertures 34 relative to top 14 and bottom 16. The opposite ends of rods 32 are threaded, with the upper end threadably receiving a barrel nut 36 and the lower end threadably receiving a hex nut 37. In the preferred form, apertures 34 of bottom 16 are counterbored to recess nuts 37 within the outer surface of bottom 16. In the most preferred form, seven tension rods 32 are provided, with one located at each corner inwardly of grooves 28 and 30, one located adjacent to the back edges of top 14 and bottom 16 intermediate the end edges thereof, and two located adjacent the front edges of top 14 and bottom 16 intermediate the end edges thereof and adjacent to and inwardly of the free ends of grooves 30. Thus, three rods 32 are arranged linearly along a line parallel to and spaced from the back edges of top 14 and bottom 16 and four rods 32 are arranged linearly along a line parallel to and spaced from the front edges of top 14 and bottom 16 and in a non-linear manner and thus spaced from the line of the back three rods 32.

In the most preferred form, hutch 10 further includes a pair of spaced adjustment bolts 38 threadably received in top 14 aligned within each of first and second grooves 28 and 30 to abut with the upper edges of ends 18 and sides 22. In the most preferred form, bolts 38 are threadably received in inserts 39 in turn threadably received in top 14. Thus, bolts 38 can be threaded in and out of insert 39 a multiple of times without damage to the threadable connection between top 14 and insert 39. Further, the threads of bolts 38 can be relatively fine for ease of adjustment whereas the threads of inserts 39 can be relatively course for gripping the material forming top 14.

In the preferred form, the frame of hutch 10 is formed by compressively capturing ends 18 in and between grooves 28 of top 14 and bottom 16 and by compressively capturing sides 22 in and between grooves 30 of top 14 and bottom 16. In the preferred form, top 14 and bottom 16 are initially captured upon rods 32 by sandwiching top 14 and bottom 16 between the circular flanges of collars 35 and nuts 36 and 37. It can then be appreciated that top 14 is generally held in a parallel relation to bottom 16 by rods 32. After the attachment of top 14 and bottom 16 to rods 32 and with bolts 38 threaded to an outer position in inserts 39, ends 18 and front sides 22 can be positioned in grooves 28 and 30, respectively. For example, with the distance between the bottoms of grooves 28 and 30 being greater than the height of ends 18 and sides 22 and the distance between the inner surfaces of top 14 and bottom 16 held by rods 32 being less than the height of ends 18 and sides 22, the top edges of ends 18 and sides 22 can be angled into and slid in grooves 28 and 30 of top 14 to an extent that ends 18 and sides 22 can be pivoted to position the bottom edges of ends 18 and sides 22 in line with and slid into grooves 28 and 30. If desired, grooves 28 and 30 of top 14 can have a greater depth than grooves 28 and 30 of bottom 16. With ends 18 and sides 22 in position in grooves 28 and 30, bolts 38 can be threaded into inserts 39 to abut with the upper edges of ends 18 and sides 22 placing a compressive force on ends 18 and sides 22 and placing a tension force on rods 32. Thus, ends 18, sides 22, and rods 32 provide a relatively rigid frame. The upper and lower edges of back 20 can be attached at least at spaced locations such as to the back edges of top 14 and bottom 16 by any suitable means such as screws, with back 20 providing lateral or diagonal support for preventing the frame of hutch 10 from twisting.

Shelves 40 can be provided between ends 18, back 20 and sides 22 and adjustably supported at a plurality of positions intermediate top 14 and bottom 16, with two shelves 38 being shown in the preferred form. In the most preferred form, shelf supports 42 are provided adjustably slideable on at least three tension rods 32 arranged in a non-linear arrangement and in the preferred embodiment shown on all seven tension rods 32. In the most preferred form, supports 42 are in the form of short stub shafts or rods of a diameter slightly larger than that of rods 32 and having diametric bores 44 therethrough for slideable receipt on tension rods 32. Axially extending set screws 46 are threadably received in the stub shafts and abut with tension rods 32 within bores 44. It can then be appreciated that each shelf support 42 is adjustably positionable on its respective rod 32 independent of the position of the other shelf supports 42 on their respective rods 32. In the most preferred form, each shelf 40 rests upon and is supported upon supports 42 fixed in position at the desired shelf height on each of the seven tension rods 32. Further, in the most preferred form, clear plastic caps 47 are positioned over the ends of supports 42 upon which shelves 40 abut. In the most preferred form, tension rods 32 and supports 42 are formed from steel with a highly reflective chrome plating.

In the preferred form, front sides 22 extend at a perpendicular angle between first and second ends 18 and in the preferred form are arranged linearly parallel to and spaced from the front and back edges of top 14 and bottom 16. As can be appreciated, the inner edges of sides 22, top 14, and bottom 16 define a front opening. In the preferred form, the front opening is closed by door panels 24. Further, in the most preferred form, door panels 24 are pivotally mounted to top 14 and bottom 16 for pivotal movement between open and closed positions. In the preferred form shown, the outer, upper and lower corners of door panels 24 include a bracket 48 slideably captured thereon. Each bracket 48 includes a pivot pin 50 extending therefrom and into pivot apertures 52 located in top 14 and bottom 16 inwardly of the free ends of and in line with grooves 28, with pins 50 of brackets 48 and apertures 52 of each panel 24 being vertically in line. During assembly, pins 50 can be first inserted into apertures 52 of top 14 and then inserted into apertures 52 of bottom 16 in a similar manner as ends 18 and sides 22 are inserted into grooves 28 and 30. It can then be appreciated that pins 50 form the pivot axis for door panels 24.

Now that the basic construction of hutch 10 according to the preferred teachings of the present invention has been explained, the advantages of hutch 10 can be set forth and appreciated. Specifically, ends 18, the front, and back 20 of the frame of hutch 10 can be formed of relatively low strength material such as glass. Further, as ends 18, sides 22, panels 24 and shelves 40 are formed of glass and caps 47 are formed of clear plastic, the aesthetic visual effect or impact created is that of top 14 floating in space above bottom 16 due to the minimal visual effect of tension rods 32 and shelf supports 42. This overall visual impact is further enhanced due to the mirrored face 26 of back 20 and the highly reflective chrome plating of tension rods 32 and shelf supports 42 which because of their reflective nature create a continuing visual effect which visually masks even the minimal physical presence of rods 32 and supports 42.

It is respectfully submitted that the particular approach utilized for placing ends 18 and sides 22 under compressive forces and rods 32 under tension forces is advantageous. Particularly, bolts 38 within inserts 39 are of a clearly less complicated structure and adjustment than if collars 35 were adjustable on rods 32. Further, the use of a pair of bolts 38 to abut the upper edges insure that even compressive forces are placed on ends 18 and sides 22 to take up any tolerance variations existing in top 14, bottom 16, ends 18, sides 22, and the depth of grooves 28 and 30. Also, the circular flanges of collars 35 and nuts 36 and 37 will hold top 14 relative to bottom 16 and apertures 34 receiving the ends of rods 32 will hold rods 32 relative to each other and top 14 and bottom 16 to prevent collapse in the event that one or more ends 18 and sides 22 should be broken or in any way collapse.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Hutch comprising, in combination: a top having an inner surface; a bottom having an inner surface; first and second ends having upper and lower edges; means on the inner surface of the top for slideably receiving the upper edges of the ends; means on the inner surface of the bottom for slideably receiving the lower edges of the first and second ends; and means for compressively capturing the first and second ends between the slideably receiving means, wherein the compressively capturing means comprises, in combination: means for holding the top generally parallel to the bottom; and means separate from the holding means and carried by the top for adjustably abutting with the first and second ends while the top is being held generally parallel to the bottom by the holding means for placing compressive forces on the first and second ends between slideably receiving means and for placing tension forces on the holding means.

2. The hutch of claim 1 further comprising, in combination: a back, with the back secured to the top and the bottom to provide diagonal support for preventing the top, the bottom, and the first and second sides from twisting.

3. The hutch of claim 1 wherein the slideably receiving means comprise grooves formed in the top and in the bottom.

4. The hutch of claim 1 further comprising, in combination: at least a first front side having upper and lower edges; means on the inner surface of the top for slideably receiving the upper edge of the front side; and means on the inner surface of the bottom for slideably receiving the lower edge of the front side, with the front side extending at an angle between the first and second ends.

5. The hutch of claim 1 wherein the holding means comprises tension rods extending between the top and the bottom.

6. The hutch of claim 5 further comprising, in combination: at least a first shelf; and means adjustably positionable on the tension rods for supporting the shelf intermediate the top and the bottom.

7. The hutch of claim 5 wherein the holding means further comprises, in combination: first and second collars secured to the tension rods for abutting with the inner surfaces of the top and bottom.

8. The hutch of claim 7 wherein the first and second collars are rotatably fixed to the tension rods and to the top and bottom.

9. The hutch of claim 1 wherein the adjustably abutting means comprises means for abutting with the upper edges of each of the ends at spaced locations.

10. The hutch of claim 9 wherein the abutting means for each of the ends comprises first and second bolts threadably secured to the top.

11. Hutch comprising, in combination: a top having an inner surface; a bottom having an inner surface; first and second ends having upper and lower edges; means on the inner surface of the top for slideably receiving the upper edges of the ends; means on the inner surface of the bottom for slideably receiving the lower edges of the first and second ends; at least three tension rods extending between the top and the bottom in parallel, spaced relation and in a non-linear arrangement; at least a first shelf; and independent shelf supports slideably adjustable upon each of the tension rods for adjustably supporting the shelf at a plurality of positions intermediate the top and the bottom.

12. The hutch of claim 11 wherein the shelf supports include a bore for slideably receiving the tension rod and means adjustably movable relative to the bore for abutting with the tension rod inside of the bore.

13. The hutch of claim 12 further comprising, in combination: means for compressively capturing the first and second ends between the slideably receiving means; and wherein the compressively capturing means comprises, in combination: the tension rods for holding the top generally parallel to the bottom, and means separate from the tension rods and carried by the top for adjusting the compressive forces capturing the first and second ends between the slideably receiving means while the top is being held generally parallel to the bottom by the tension rods.

14. The hutch of claim 13 wherein the adjusting means comprises means for abutting with the upper edges of each of the ends at spaced locations.

15. The hutch of claim 14 wherein the abutting means for each of the ends comprises first and second bolts threadably secured to the top.

16. The hutch of claim 12 wherein the shelf support comprises a stub shaft having a circular cross section of a constant diameter slightly larger than that of the rods; wherein the bore extends diametrically through the stub shaft; and wherein the abutting means comprises a set screw threadably received in the stub shaft and abutting with the outer surface of the tension rods.

17. The hutch of claim 16 wherein the set screw is threadably received axially in the stub shaft.

18. Hutch comprising, in combination: at least three vertical rods extending in parallel, spaced relation and in an non-linear arrangement; at least a first shelf having a length and width, with each of the vertical rods including an independent shelf support slideably positionable on the vertical rod and having a radial extent from the vertical rod which is substantially smaller than the length and the width of the shelf, wherein the shelf supports each include a bore for slideably receiving the vertical rod and means adjustably movable relative to the bore for abutting with the vertical rod inside of the bore, and with the shelf support being adjustably positionable on the vertical rod independent of the position on the shelf supports on the other vertical rods, with the shelf resting upon the shelf supports of the three vertical rods.

19. The hutch of claim 18 comprising, in combination: a top having an inner surface; a bottom having an inner surface; first and second ends having upper and lower edges; means on the inner surface of the top for slideably receiving the upper edges of the ends; means on the inner surface of the bottom for slideably receiving the lower edges of the first and second ends; and means separate from the vertical rods and carried by the top for adjustably abutting with the first and second ends while the top is being held generally parallel to the bottom by the vertical rods with the vertical rods being tensioned between the top and bottom and the first and second ends being compressively captured between the slideably receiving means.

20. The hutch of claim 18 wherein the shelf support comprises a stub shaft having a circular cross section of a constant diameter slightly larger than that of the rods; wherein the bore extends diametrically through the stub shaft; and wherein the abutting means comprises a set screw threadably received in the stub shaft and abutting with the outer surface of the tension rods.

21. The hutch of claim 20 wherein the set screw is threadably received axially in the stub shaft.

* * * * *

UNITED STATES PATENT AND TRADEMARK OFFICE

CERTIFICATE OF CORRECTION

PATENT NO. : 5,234,267

DATED : August 10, 1993

INVENTOR(S) : Jericho P. Pauer et al.

It is certified that error appears in the above-identified patent and that said Letters Patent is hereby corrected as shown below:

Column 1, line 65, before "portions" insert --with--.

Column 1, line 65, after "phantom." insert the following paragraphs:

--Figure 1a shows an enlarged perspective view of the area encircled in the hutch of Figure 1.

Figure 1b shows an exploded, perspective view showing construction details of the end of the hutch of Figure 1.--.

UNITED STATES PATENT AND TRADEMARK OFFICE

CERTIFICATE OF CORRECTION

PATENT NO. : 5,234,267

DATED : August 10, 1993

INVENTOR(S) : Jericho P. Pauer et al.

It is certified that error appears in the above-indentified patent and that said Letters Patent is hereby corrected as shown below:

Column 4, line 1, cancel "38" and substitute therefor --40--.

Column 5, line 40, after "between" insert --the--.

Column 6, line 4, cancel "rotatably" and substitute therefor --rotationally--.

Column 6, line 68, cancel "on" and substitute therefor --of--.

Signed and Sealed this

Tenth Day of May, 1994

Bruce Lehman

*Attest:*

BRUCE LEHMAN

*Attesting Officer*

*Commissioner of Patents and Trademarks*